US006417493B1

(12) United States Patent
Bales et al.

(10) Patent No.: US 6,417,493 B1
(45) Date of Patent: Jul. 9, 2002

(54) SELF-CLEANING METHOD FOR A COOKING APPLIANCE

(75) Inventors: Michael E. Bales, Cleveland; John Scott Brown, Charleston; Robert Z. Whipple, Jr., Loudon, all of TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/983,840

(22) Filed: Oct. 26, 2001

Related U.S. Application Data

(63) Continuation-in-part of application No. 09/650,416, filed on Aug. 29, 2000, now Pat. No. 6,316,749.

(60) Provisional application No. 60/153,226, filed on Sep. 13, 1999.

(51) Int. Cl.[7] ..... A21B 1/26; A21B 1/40; F24L 14/02

(52) U.S. Cl. ..... 219/400; 219/412; 219/494; 219/413

(58) Field of Search ..... 219/400, 412, 219/413, 391, 492, 494; 126/21 A

(56) References Cited

U.S. PATENT DOCUMENTS

| | | | |
|---|---|---|---|
| 3,166,895 | A | 1/1965 | Slayter et al. |
| 3,327,094 | A | 6/1967 | Martin et al. |
| 3,428,434 | A | 2/1969 | Hurko |
| 3,428,435 | A | 2/1969 | Hurko et al. |
| 3,440,402 | A | 4/1969 | Holtkamp |
| 3,480,000 | A | 11/1969 | Torrey et al. |
| 3,549,859 | A | 12/1970 | Faehling et al. |
| 3,553,425 | A | 1/1971 | Fry |
| 3,556,077 | A | 1/1971 | Tilus |
| 3,656,469 | A | 4/1972 | Jung et al. |
| 3,669,090 | A | 6/1972 | Jung et al. |
| 3,727,601 | A | 4/1973 | Klement |
| 3,899,656 | A | 8/1975 | Smith |
| 3,915,149 | A | 10/1975 | Kemp |
| 3,962,561 | A | 6/1976 | Maitenaz |
| 4,039,292 | A | 8/1977 | Morini et al. |
| 4,054,418 | A | 10/1977 | Miller et al. |
| 4,238,670 | A | 12/1980 | Maitenaz |
| 4,302,661 | A | 11/1981 | Perry, Jr. |
| 4,374,319 | A | 2/1983 | Guibert |
| 4,375,213 | A | 3/1983 | Kemp et al. |
| 4,392,038 | A | 7/1983 | Day et al. |
| 4,493,976 | A | 1/1985 | Wilson |
| 4,547,642 | A | 10/1985 | Smith |
| 4,827,106 | A | 5/1989 | Margraf |
| 4,831,237 | A | 5/1989 | Gelineau |
| 4,926,837 | A | 5/1990 | Parker et al. |
| 4,954,694 | A | 9/1990 | Nagai et al. |
| 5,083,010 | A | 1/1992 | Henry et al. |
| 5,205,273 | A | 4/1993 | Sparks et al. |
| 5,286,943 | A | 2/1994 | Has |
| 5,343,020 | A | 8/1994 | Waigand et al. |
| 5,386,099 | A | 1/1995 | Has |
| 5,534,678 | A | 7/1996 | Bowles et al. |
| 5,571,433 | A | 11/1996 | Baker |
| 5,964,211 | A | 10/1999 | Sargunam et al. |

FOREIGN PATENT DOCUMENTS

| | | |
|---|---|---|
| DE | 2166227 | 12/1978 |

*Primary Examiner*—Joseph Pelham
(74) *Attorney, Agent, or Firm*—Diederiks & Whitelaw, PLC

(57) ABSTRACT

A self-cleaning system for a convection cooking appliance controls the activation and deactivation of multiple heating units, as well as a blower, throughout an initial preheat and subsequent phases of a cleaning operation. In accordance with the preferred self-cleaning method, an initial, catalyst pre-heat stage is followed by a moderately high-temperature presoak stage. For the main cleaning operation, a high temperature stage is initiated in combination with a high convection air flow to establish high oven surface temperatures in a minimal time frame. This timed stage is followed by a cool down period wherein both the temperature and convection speed is reduced. Thereafter, an intermediate temperature heating stage with medium convective air flow followed by a cooling stage are provided for preset time periods. This combination of intermediate temperature heating and subsequent cooling stages is repeated until the total self-cleaning time is completed.

20 Claims, 5 Drawing Sheets

SELF-CLEANING METHOD FOR A COOKING APPLIANCE

The present application represents a continuation-in-part of U.S. patent application Ser. No. 09/650,416 filed Aug. 29, 2000, now U.S.Pat. No. 6,316,749 which claimed priority from U.S. Provisional Application Ser. No. 60/153,226 filed Sep. 13, 1999.

BACKGROUND OF THE INVENTION

1. Field of the Invention

The present invention pertains to the art of cooking appliances and, more particularly, to a method for cleaning a cooking appliance.

2. Discussion of the Prior Art

In the art of cooking appliances, it has been heretofore proposed to enable an appliance to operate in a self-cleaning mode. For example, in a conventional range having a cooking cavity which can be heated by one or more cooking elements arranged within the cooking cavity to perform at least baking and broiling functions, it is known to operate one or more of the cooking elements to perform a pyrolytic self-cleaning operation in order to cleanse the walls of the cavity from grease and other food soils developed during normal cooking operations. In such a cooking arrangement, the cooking elements used to perform the cleaning process are located entirely within the cooking cavity.

In addition, it is known to provide a catalytic self-cleaning oven. In such an arrangement, the walls of the oven are coated with a catalytic material which provides for self-cleaning of the oven cavity during cooking operations. In performing any self-cleaning function, byproducts, including smoke, gases and other odorous fumes, are inherently produced. A typical oven cavity will be vented to permit the escape of these byproducts to the ambient surroundings. In some cases, a catalytic oxidation unit is provided in the vent to react with the flowing byproducts.

In still other self-cleaning arrangements, a combination of pyrolytic and catalytic cleaning is performed. Regardless of the fact that various self-cleaning systems have been proposed in the art, there still exists a need for an improved self-cleaning system for a cooking appliance which maximizes the elimination of byproducts, while also minimizing the necessary operating time for the self-cleaning mode. Particular concerns are raised in connection with the necessary operating time and byproduct elimination in a self-cleaning convection oven which essentially relies on a heated flow of recirculating air for raising the temperature in an oven cavity. In any event, there exists a particular need for an improved self-cleaning system for a convection cooking appliance, as well as an improved cleaning method for such a cooking appliance.

SUMMARY OF THE INVENTION

The present invention is directed to a system for self-cleaning an oven cavity of a convection cooking appliance, particularly an appliance including an air channel assembly which is defined by ducting extending about portions of the oven cavity for directing a recirculating flow of air into and out of the oven cavity. The overall system utilizes various heating elements, as well as a catalyst, to enhance the pre-heating of the oven cavity, efficiently eliminate developed smoke, odor and other byproducts, and effectively reduce the necessary cleaning cycle time for the appliance.

In accordance with a preferred embodiment of the invention, the convection cooking appliance includes first, second and third heating units which are individually controlled, along with a blower unit, in performing a self-cleaning function for the appliance. The first and third heating units are disposed in the air channel assembly, while the second heating unit is positioned in the oven cavity. A controller is provided for regulating the activation and deactivation state of the various components in a manner which preheats the oven cavity in a relatively short time period, while assuring that initially developed smoke, gases and other odorous fumes inherently produced as byproducts of a self-cleaning operation are effectively eliminated.

During the preheat phase of the cleaning mode, the controller initially activates the blower element in combination with each of the first and third heating units in the air channel assembly, with the developed flow of air through the oven cavity being directed to the catalyst for elimination of the byproducts. Following the preheat phase, at least the blower and the third heating element are deactivated and the second heating unit is activated to rapidly heat the oven cavity through a radiant heating operation. A temperature sensor is linked to the controller to efficiently determine the optimum time to switch between the various heating sources for the oven cavity during the overall self-cleaning operation.

In accordance with a preferred self-cleaning method according to the invention, an initial, catalyst pre-heat stage, established mainly for smoke elimination purposes, is followed by a moderately high-temperature presoak stage to bum off various light molecular weight hydrocarbons and the like. For the main cleaning operation, a high temperature stage is initiated in combination with a high convection air flow to establish high oven surface temperatures in a minimal time frame. This timed stage is followed by a cool down period wherein both the temperature and the convection speed are reduced. Thereafter, providing an intermediate temperature heating stage with medium convective air flow, followed by a cooling stage, is provided for preset time periods. This combination of intermediate temperature heating and subsequent cooling stages is repeated until the total self-cleaning time is completed.

Additional objects, features and advantages of the present invention will become more fully apparent below with reference to a preferred embodiment of the invention, when taken in conjunction with the drawings wherein like reference numerals refer to corresponding parts in the several views.

DETAILED DESCRIPTION OF THE PREFERRED EMBODIMENT

Figure 1:
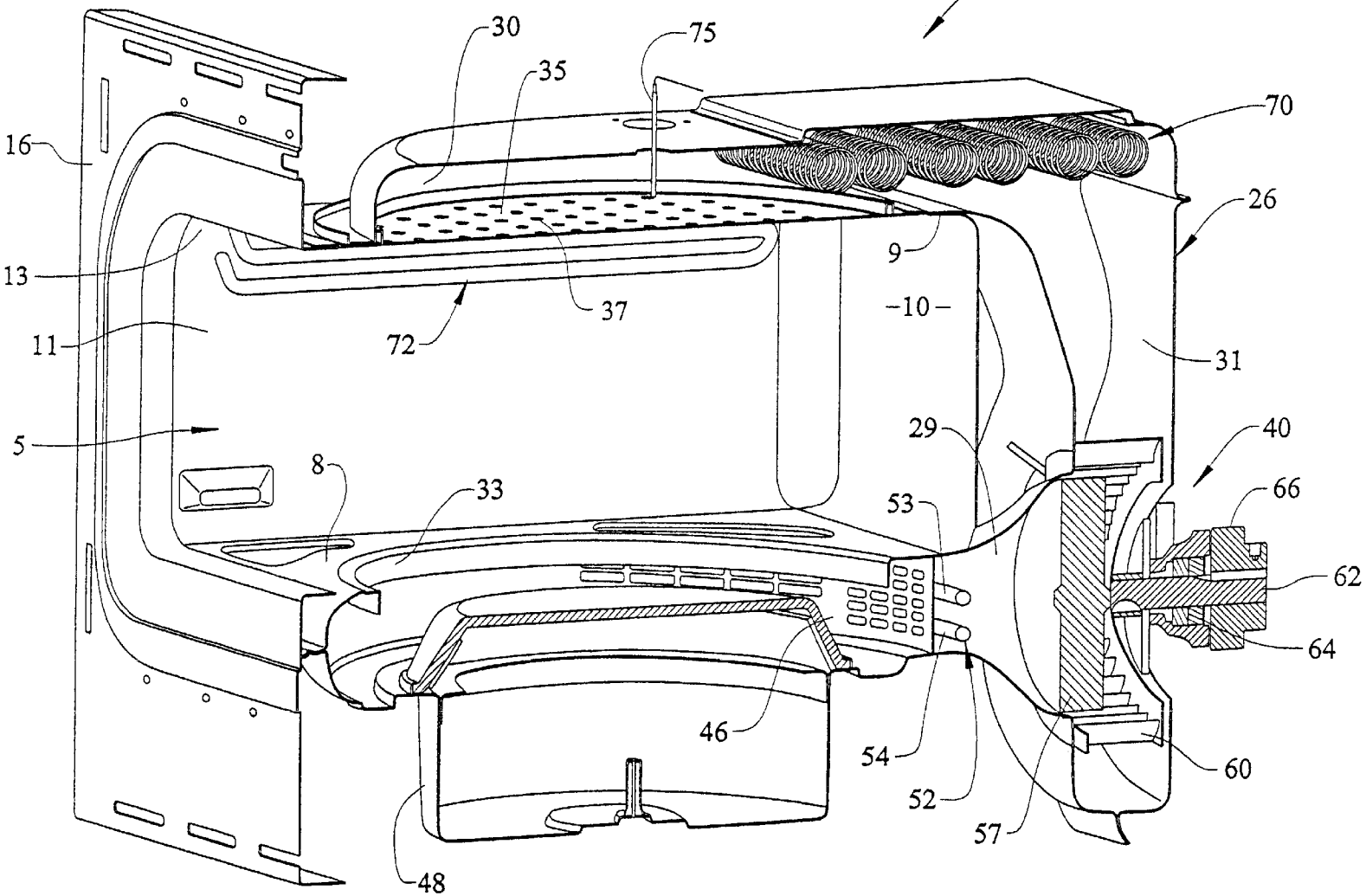
FIG. 1 is a perspective, partial sectional view of a self-cleaning convention cooking appliance constructed in accordance with the present invention.
Figure 2:
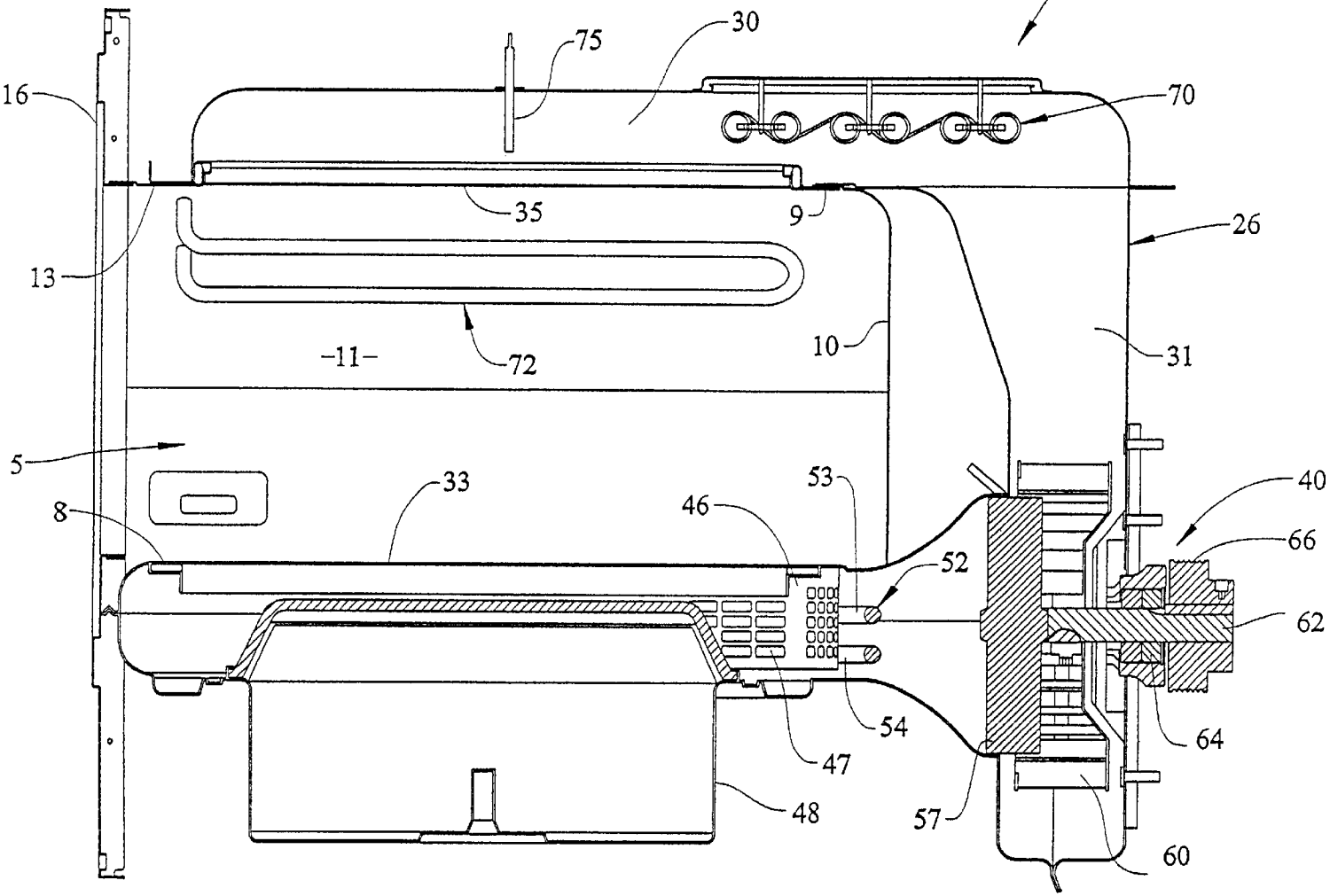
FIG. 2 is a cross-sectional side view of the cooking appliance of FIG. 1.
Figure 3:
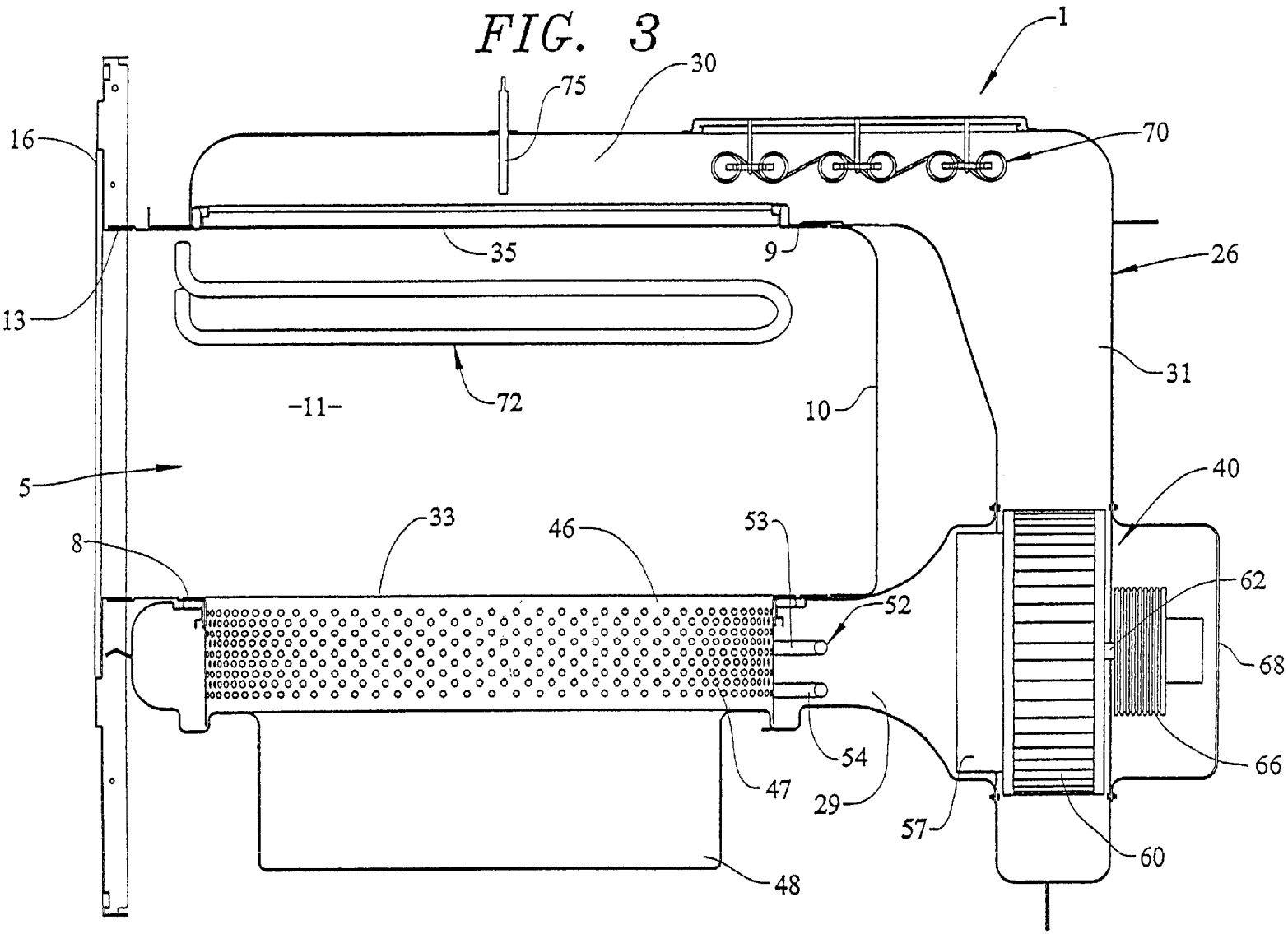
FIG. 3 is a schematic side view, similar to that of FIG. 2, of the cooking appliance.

With initial reference to FIGS. 1–3, a cooking appliance 1 is schematically shown in the form of a wall oven.

Appliance 1 includes an oven cavity 5 generally defined by a bottom wall 8, a top wall 9, a rear wall 10 and a pair of side walls, one of which is indicated at 11. Oven cavity 5 also has associated therewith an access opening 13 for food items to be placed into or withdrawn from cavity 5. About access opening 13 is provided a frontal plate 16. In a manner known in the art, frontal plate 16 is adapted to be mounted against a substantially vertical wall such as in the kitchen of a residential home, and would have a door (not shown) pivotally attached thereto for selectively sealing off access opening 13.

Extending generally along top, bottom and rear portions of cavity 5 is an air channel assembly 26 defined by ducting that leads into and out of cavity 5. More specifically, air channel assembly 26 includes a lower air return section 29, an upper air delivery section 30 and a rear air transfer section 31. Lower air return section 29 is open into cavity 5 through a substantially central return air outlet 33 formed in bottom 8. In the most preferred form of the invention, return air outlet 33 is constituted by a generally circular insert provided with various spaced holes (not shown). In a similar manner, upper air delivery section 30 includes a discharge or delivery inlet 35 formed in top wall 9. Although only partially shown in FIG. 1, inlet 35 is also preferably constituted by a generally circular-shaped insert which is attached to the remainder of upper air delivery section 30 and which is provided with a plurality of holes 37.

As will become more fully evident below, the particular construction of cooking appliance 1 can significantly vary in accordance with the present invention. More specifically, it is only important in accordance with the present invention that cooking appliance 1 include an air channel assembly, such as that discussed above with reference to assembly 26, as well as a blower assembly, such as that generally indicated at 40, for use in generating a circulating flow of air through oven cavity 5. Although not considered a part of the present invention, a preferred construction for oven cavity 5 and air channel assembly 26 can be found in U.S. patent application Ser. No. 09/649,957 entitled "OVEN CAVITY CONSTRUCTION" filed on Aug. 29, 2000 which is hereby incorporated by reference.

In the preferred embodiment shown, cooking appliance 1 constitutes an electric appliance and, more specifically, a combination convection, microwave and radiant cooking device. As shown in this figure, cooking appliance 1 is provided with an annular filter basket 46, having a multitude of circumferentially spaced holes 47, which is positioned within lower air return section 29 and through which the air flowing from cavity 5 through return air outlet 33 is directed. Arranged below filter basket 46 is a microwave generator unit 48 incorporating a magnetron (not specifically shown).

Encircling at least a portion of filter basket 46 is a first electric heating element 52. Heating unit 52 is shown as constituted by a sheathed electric resistance heating element having upper and lower interconnected legs 53 and 54. First electric heating unit 52 is preferably provided to heat return air flowing from oven cavity 5, through outlet 33 and filter basket 56 prior to the air reaching a catalyst indicated at 57. In a manner known in the art, catalyst 57 functions to eliminate smoke and the like from the air stream. As shown, catalyst 57 extends partially within a rotatable blower element 60 which forms part of blower assembly 40. Although blower element 60 can take various forms while performing the desired air flow generating function, blower element 60 preferably constitutes a centrifugal unit arranged at the juncture of lower air return section 29 and rear air transfer section 31. In general, blower element 60 is secured to a shaft member 62 that is rotatably mounted through a bearing assembly 64. Shaft member 62 also has attached thereto, for non-relative rotation, a sheave 66 which is adapted to receive a belt (not shown) for use in rotating blower element 60 through shaft member 62 in combination with an electric motor (also not shown). As illustrated, sheave 66 is preferably arranged within a housing extension 68 which projects from rear air transfer section 31.

Preferably mounted in upper air delivery section 30 adjacent rear transfer section 31 is a second electric heating element arrangement 70 that is preferably constituted by a bank of heating coils. Although not pertinent to the present invention, second heating unit 70 can be defined by a single electric coil that runs back and forth across upper air delivery section 30 or multiple, separately controllable coil elements. In any event, second heating unit 70 functions to further heat the air flowing through channel assembly 26 prior to the air reaching discharge inlet 35.

Also shown in this figure is a third electric heating unit 72 which, in a manner similar to first electric heating unit 52, is preferably constituted by a sheathed, resistance-type heating element. Third electric heating unit 72 preferably extends adjacent top wall 9 and constitutes an additional heat source for cavity 5 of cooking appliance 1. The particular manner in which first, second and third electric heating units 52, 70 and 72 are utilized during operation of cooking appliance 1 for a cooking mode of operation is not considered to constitute part of the present invention. Instead, these details can be found in U.S. Pat. No. 6,291,808 entitled "HEATING SYSTEM FOR A COOKING APPLIANCE" incorporated by reference.

Figure 4:
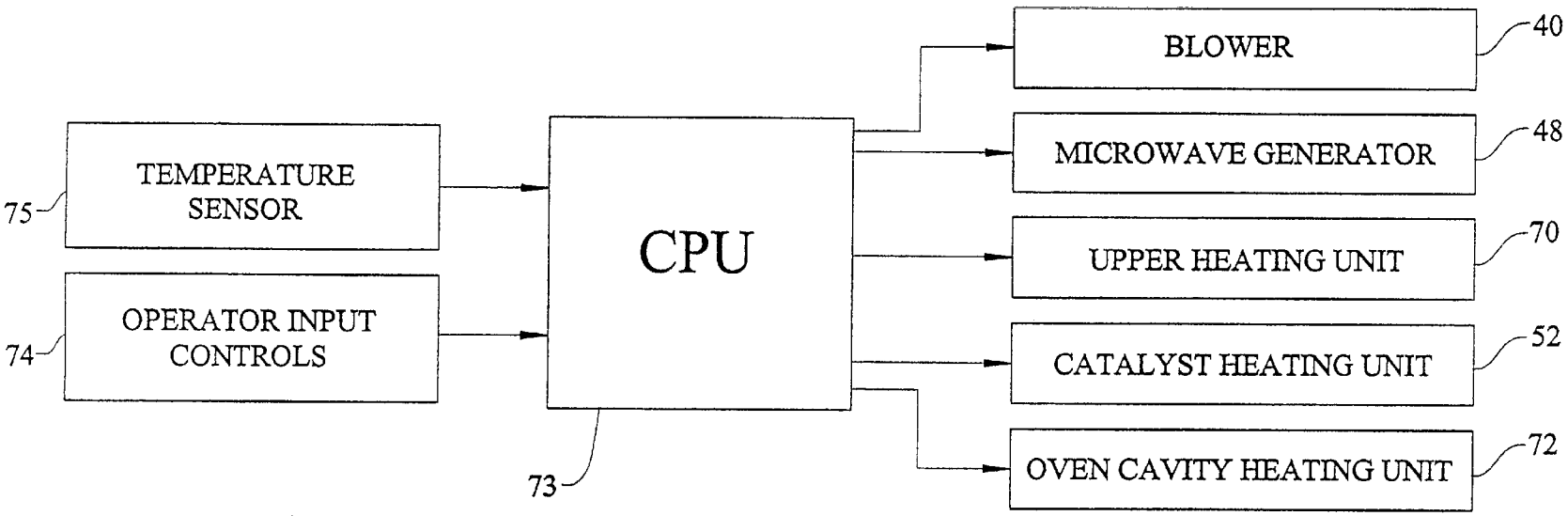
FIG. 4 is a block diagram illustrating a control arrangement used in the self-cleaning system of the invention.

As represented in FIG. 4, each of blower assembly 40, microwave generator 48 and first, second and third electric heating units 52, 70 and 72 are linked to an appliance controller or CPU 73. Controller 73 also receives signals from operator input controls 74, as well as from a temperature sensor 75 which is preferably arranged in upper air delivery section 30, between heating unit 70 and delivery inlet 35. The present invention is particularly directed to the manner in which cooking appliance 1 is operated through a cleaning mode.

When an operator selects a cleaning mode through input controls 74, heating units 52 and 70 are initially activated, along with blower assembly 40, for preheating of oven cavity 5. At the same time, during this preheat phase, heating unit 72 is maintained deactivated. This operational stage enables the oven cavity 5 to be heated in a substantially exponential manner as represented by the portion A of the time/temperature curve shown in FIG. 5. This arrangement is designed to provide for a relatively short preheat time period, while assuring that early stage self-clean byproducts will flow to the catalyst for effective elimination. That is, it is this initial time period that substantial amounts of smoke, odors and other byproducts will be developed due to the burning off of grease and the like remaining in the oven cavity 5. By maintaining heating unit 72 deactivated, it has been found that an optimum preheat rate is established, with the temperature rise being based on the flow of heated air directed through the oven cavity 5.

Figure 5:
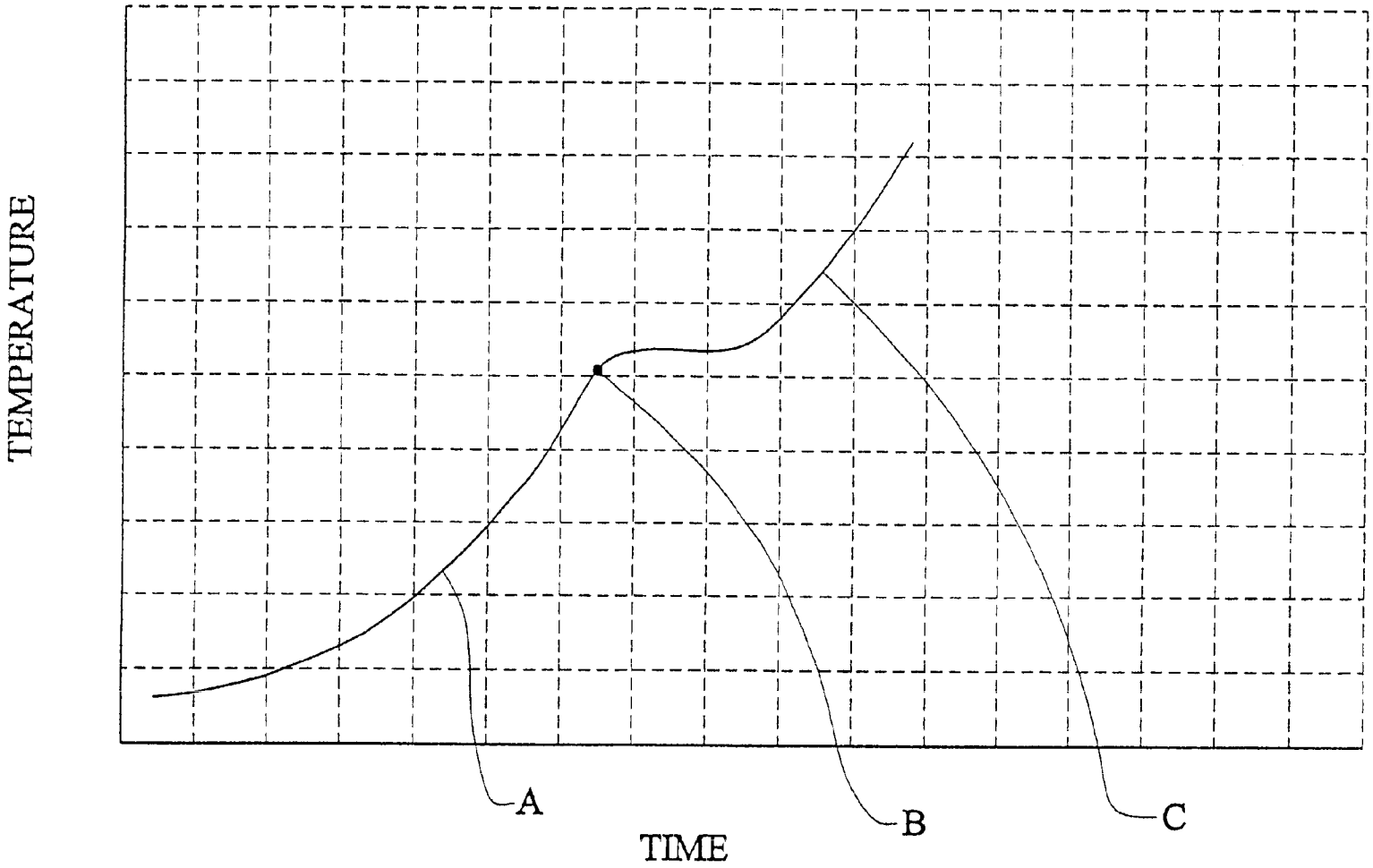
FIG. 5 depicts a graph illustrating a time versus temperature curve followed in accordance with a preferred embodiment of the invention.

When the temperature in oven cavity 5 reaches point B on the curve shown in FIG. 5 as conveyed through temperature sensor 75, blower assembly 40 and heating unit 70 are deactivated, while heating unit 52 remains activated and heating unit 72 in oven cavity 5 is also activated, through controller 73. With blower element 40 deactivated, the air flowing through air channel assembly 26 is based on natural convection only. This switchover phase results in a short, generally steady state time period wherein the temperature within oven cavity 5 remains substantially constant. However, electric heating unit 72 is preferably a high wattage element which rapidly heats such that the temperature within oven cavity again rises exponentially, as represented by portion C in FIG. 5. In fact, as clearly shown, portion C has an even higher associated slope than portion A. With this overall control arrangement, the preheat phase is performed at a rate which assures that the developed byproducts are effectively eliminated and vented through catalyst 57, while the subsequent rapid heating of oven cavity 5 with heating unit 72 enables the time needed to perform the overall self-cleaning operation to be minimized.

In accordance with one preferred embodiment of the invention, a maximum cleaning algorithm which is configured to provide maximum energy to clean oven cavity 5 plus maintain specified surface temperatures. The algorithm employs timed periods of very high thermal and forced air energy to maximize BTU delivery onto the surfaces of oven cavity 5. With this arrangement, consumption of the cooking deposits can be maximized. In general, the process is based on the chemical and thermodynamic principles that reactions increase in rate as the temperature increases.

More specifically, the self-clean algorithm starts with a catalyst heating sequence designed to eliminate smoking of various components during thermal start-up of the self-clean operation. This start-up phase directly corresponds to that described above. After the start-up phase, a moderately high presoak operation is performed to essentially burn off various light molecular weight hydrocarbons and the like. In accordance with the most preferred form of the invention, the presoak operation establishes a temperature in the order of 750° F.

In essence, the start-up and presoak phases are precursors to the main cleaning stages. In a first main stage, maximum thermal heat is applied with maximum air flow to drive the surface temperatures within oven cavity 5 to high levels. In accordance with the most preferred form of the invention, this stage operates at approximately 990° F. and a 4,800 rpm blower speed for 10 to 15 minutes. This established temperature provides the energy necessary to convert the majority of the cooking byproducts into water and carbon dioxide.

Following this first main stage, a timed cool down sequence is employed. In this cool down stage, the thermal input is reduced, preferably to approximately 930° F. which represents a desired minimum cleaning temperature, and the air flow is reduced. Most preferably, the air flow is reduced in half by decreasing the speed of blower assembly 40 to approximately 2,400 rpm. With this arrangement, thermal heating/time relationships are used to minimize the effects of the first main cleaning stage. This cool down stage is preferably maintained for in the order of 10 to 15 minutes.

The cool down stage is followed by an intermediate high temperature and blower timed stage. Most preferably, the established temperature for this stage is approximately 960° F. with a blower speed of 3,600 rpm. This stage is preferably preset for 10 minutes and is followed by a repeat of the cool down or cooling stage as set forth above. Thereafter, this intermediate high temperature and blower timed stage and following cool down stage combination is continuously repeated until the total self-clean time set by the user is completed.

Although described with respect to a preferred embodiment of the invention, it should be readily understood that various changes and/or modifications can be made to the invention without departing from the spirit thereof. For example, it should be noted that the various heating units, particularly heating units 52 and 70, could be variable so as to be operated at increasing wattage ratings during the cleaning mode. In addition, blower element 60 can be operated at even further variable speeds in accordance with the invention. Furthermore, although heating element 70 is preferably constituted by a single bank of open coils, multiple sets of coils could be utilized and individually controlled. In any event, the invention is only intended to be limited by the scope of the following claims.

We claim:

1. A method of performing a self-cleaning operation in a convection cooking appliance including an oven cavity, a plurality of heating elements and a blower comprising:

establishing a first cleaning stage by creating a first temperature and a first convection air flow speed in the oven cavity;

performing a second, cool down cleaning stage wherein a second temperature, which is lower than the first temperature, and a second convection air flow speed, which is less than the first convection air flow speed, are established;

establishing a third cleaning stage by providing a third temperature, which is less than the first temperature and greater than the second temperature, and a third convection air flow speed, which is less than the first convection air flow speed and greater than the second convection air flow speed; and performing a fourth cleaning stage which defines a cooling stage.

2. The method according to claim 1, further comprising: repeating the third and fourth cleaning stages for a remainder of the self-cleaning operation.

3. The method according to claim 1, further comprising: heating to approximately 990° F. in the first cleaning stage.

4. The method according to claim 3, further comprising: heating to approximately 930° F. in the second cleaning stage.

5. The method according to claim 4, further comprising: heating to approximately 960° F. in the third cleaning stage.

6. The method according to claim 1, further comprising: establishing the first convection air flow speed with a blower speed of approximately 4,800 rpm.

7. The method according to claim 6, further comprising: establishing the second convection air flow speed with a blower speed of approximately 2,400 rpm.

8. The method according to 7, further comprising: establishing the third convection air flow speed with a blower speed of approximately 3,600 rpm.

9. The method according to claim 1, wherein the first cleaning stage is performed for 10 to 15 minutes.

10. The method according to claim 9, wherein the second cleaning stage is performed for 10 to 15 minutes.

11. The method according to claim 10, wherein the third cleaning stage is performed for approximately 10 minutes.

12. The method according to claim 11, wherein the fourth cleaning stage is performed for approximately 12 minutes.

13. The method according to claim 1, further comprising: initiating the self-cleaning operation with a preheat stage.

14. The method according to claim 13, further comprising: following the preheat stage with a presoak stage, prior to the first cleaning stage.

15. The method according to claim 14, wherein the presoak stage includes heating to approximately 750° F.

16. The method according to claim 14, wherein the cooking appliance incorporates an air channel assembly extending about and being in fluid communication with the oven cavity and a catalyst positioned in the air channel assembly, with the preheat stage functioning to heat the catalyst.

17. The method according to claim 16, further comprising:

sensing operating temperatures directly in the air channel assembly of the cooking appliance; and utilizing the sensed operating temperatures to control the plurality of heating elements and the blower throughout at least the first, second and third cleaning stages.

18. The method according to claim 1, further comprising:

directing convection air flows through an air channel assembly which extends about at least a portion of and is in fluid communication with the oven cavity; and developing heat by arranging at least one of the plurality of heating elements in the air channel assembly and another one of the plurality of heating elements in the oven cavity.

19. The method according to claim 18, further comprising:

initiating the self-cleaning operation with a preheat stage; and maintaining the another one of the plurality of heating elements deactivated during the preheat stage.

20. The method according to claim 18, further comprising: heating a catalyst positioned in the air channel assembly through a further one of the plurality of heating elements.

* * * * *